US007154399B2

(12) United States Patent
Cuddihy et al.

(10) Patent No.: US 7,154,399 B2
(45) Date of Patent: Dec. 26, 2006

(54) SYSTEM AND METHOD FOR DETERMINING WHETHER A RESIDENT IS AT HOME OR AWAY

(75) Inventors: Paul Edward Cuddihy, Ballston Lake, NY (US); Meena Ganesh, Clifton Park, NY (US); Jenny Marie Weisenberg, Schenectady, NY (US); Catherine Mary Graichen, Malta, NY (US); Vrinda Rajiv, Guilderland, NY (US); Mark Mitchell Kornfein, Latham, NY (US)

(73) Assignee: General Electric Company, Niskayuna, NY (US)

( * ) Notice: Subject to any disclaimer, the term of this patent is extended or adjusted under 35 U.S.C. 154(b) by 78 days.

(21) Appl. No.: 10/822,234

(22) Filed: Apr. 9, 2004

(65) Prior Publication Data

US 2005/0237206 A1 Oct. 27, 2005

(51) Int. Cl.
*G08B 23/00* (2006.01)

(52) U.S. Cl. ..... 340/573.1; 340/506; 340/517; 340/520; 340/523; 340/526; 340/527

(58) Field of Classification Search ..... None
See application file for complete search history.

(56) References Cited

U.S. PATENT DOCUMENTS 5,045,839 A * 9/1991 Ellis et al. ..... 340/539.11
5,153,560 A * 10/1992 Ichikawa ..... 340/522
5,475,364 A 12/1995 Kenet et al.
5,476,221 A * 12/1995 Seymour ..... 236/47
5,692,215 A 11/1997 Kutzik et al. ..... 395/838
5,701,117 A * 12/1997 Platner et al. ..... 340/567
5,861,806 A * 1/1999 Vories et al. ..... 340/555
5,905,436 A 5/1999 Dwight et al.
6,002,994 A * 12/1999 Lane et al. ..... 702/188
6,108,685 A * 8/2000 Kutzik et al. ..... 709/200
6,400,265 B1 * 6/2002 Saylor et al. ..... 340/531
6,540,674 B1 4/2003 Zadrozny et al. ..... 600/300
6,587,049 B1 * 7/2003 Thacker ..... 340/573.1
6,850,159 B1 * 2/2005 Mudge ..... 340/541
2002/0171551 A1 11/2002 Eshelmkan et al. ..... 340/573.1
2003/0112139 A1 * 6/2003 Matsui et al. ..... 340/500

* cited by examiner

FOREIGN PATENT DOCUMENTS

EP 1349128 10/2003

OTHER PUBLICATIONS

Europen Search Report May 26, 2006.*

*Primary Examiner*—Benjamin C. Lee
*Assistant Examiner*—Son Tang
(74) *Attorney, Agent, or Firm*—Jenifer E. Haeckl; Jean K. Testa

(57) ABSTRACT

A system and method for monitoring whether a resident is away from home or inactive within the home. A sensor, which includes a transmitter, a processor, a timer, and a detector, watches for motion to occur within a home. Upon sensing motion, the sensor sends a first signal indicative of the motion if the timer is not currently running and waits for the motion to end. If the timer already is running, the timer is restarted at zero. Upon expiration of a predetermined timing period, the sensor transmits a second signal indicative of inactivity. By comparing the timing of the second signal and the predetermined timing period, with a third signal sent by an exterior door sensor, a determination can be made whether the resident has left the home or is inactive within the home. The system includes a database, a CPU and State Model for determining the activity state of a home.

21 Claims, 5 Drawing Sheets

SYSTEM AND METHOD FOR DETERMINING WHETHER A RESIDENT IS AT HOME OR AWAY

BACKGROUND

The invention relates generally to a system and method for monitoring activity within a home. More particularly, the invention relates to a system and method for determining, through the monitoring of in-home movement, whether a resident of a home is at home or has left the home.

With medical advancements and increased attention to proper nutrition and sufficient exercise, the world population is living longer. For example, the number of elderly persons residing in the United States is increasing, and with the advancing age of the baby boomer generation, the number of elderly persons in the United States will increase significantly over the next several decades. Additionally, increased awareness and understanding of various mental and physical disabilities has led to an increase in the number of persons having diminished mental and/or physical faculties living independently.

With the increase in elderly and disabled persons living independently has come anxiety that these elderly and disabled persons are safe and secure in their own residences. There is increased anxiety by the elderly and disabled living alone that they may become injured or incapacitated and be unable to summon assistance. That anxiety is often shared by loved ones living at a distance from the elderly and/or disabled living independently.

Currently, the anxiety felt by the elderly and disabled living alone, as well as the anxiety felt by their loved ones, is addressed through several avenues. One way to ease anxiety is through frequent visits to the home by a caregiver. Such visits can be intrusive, time consuming, and often inconvenient and not appreciated. Another way is for the elderly or disabled person to move out of the home and move into a facility better able to monitor his health. This, however, strips the person of his independence, is costly and is often unwelcome. Another way is through technological assistance or monitoring of the person in the home.

Such technological systems that assist persons in their home include Personal Emergency Response Systems. In these systems the elderly or disabled individual wears a watch, pendant or other like device and presses a button in the event of an emergency, such as a fall. The depressed button enables an alarm signal. A central monitoring facility provides assistance by responding to the alarm signal and calls the individual to identify the problem. The facility calls a predetermined list of contacts, such as relatives, neighbors or emergency services, as required by the context of the situation. While a valuable service, these systems only identify problems that occur when the individual is able to press the emergency button.

One disadvantage experienced with some known in-home monitoring systems is the inability to accurately detect whether a resident within a monitored home has been unusually inactive or is instead away from the home. These known in-home monitoring systems provide the resident with one or more button that can be pressed to indicate whether the resident is home or is away. The resident's responsibility to indicate whether he is in the house or away often goes unfulfilled, leading to a high false alert rate and low sensitivity for such known systems.

Thus, there remains a need for a system and method for ascertaining whether a resident is within a monitored home or is instead away from the home.

SUMMARY

Figure 1:
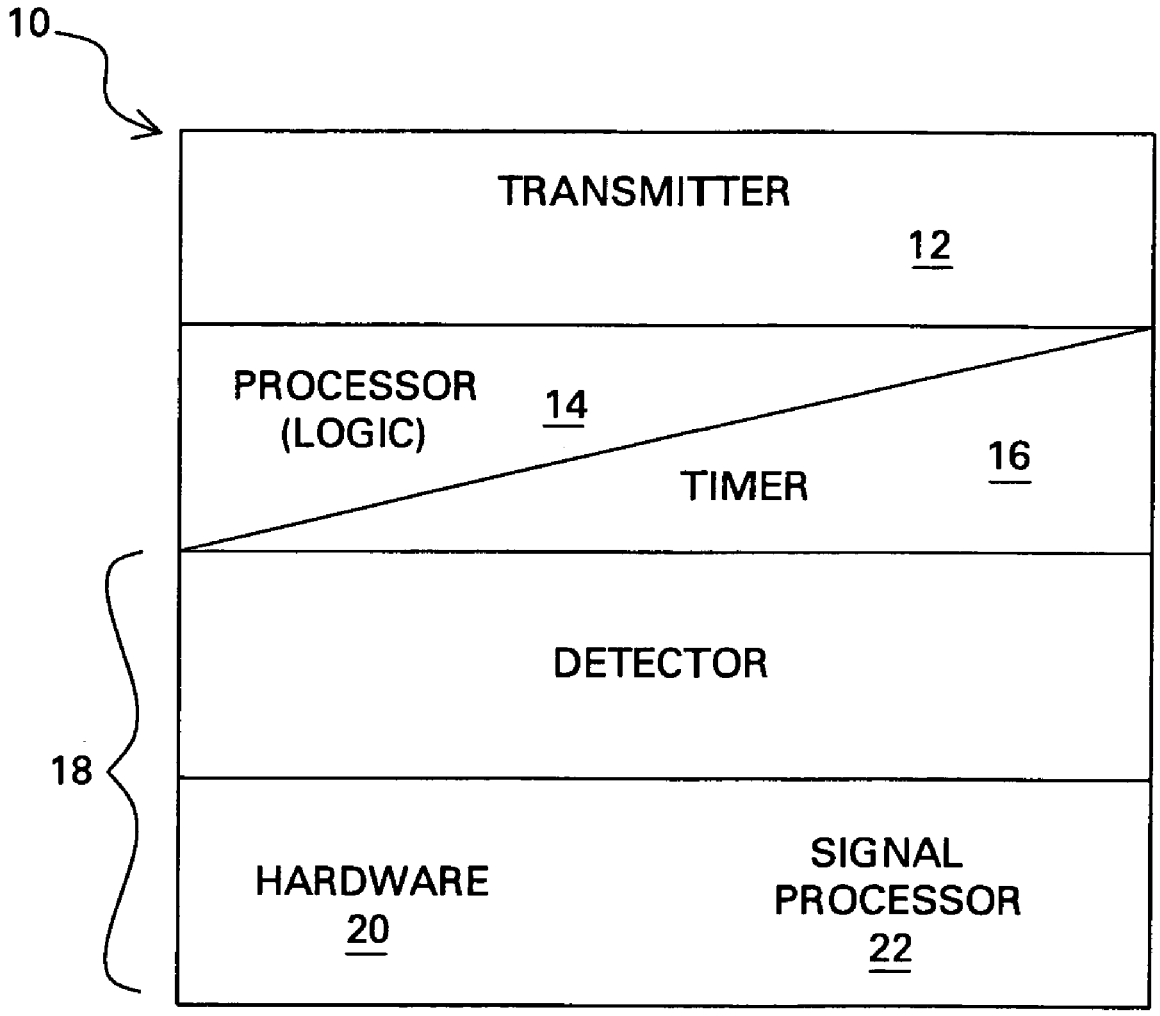
FIG. 1 is a schematic view of a motion sensor constructed in accordance with an exemplary embodiment of the invention.

The invention is directed to a system and method for ascertaining whether a resident of a monitored home is at home or has left the home.

In one exemplary embodiment of the invention is provided a system for determining whether a resident of a home is inactive within the home or away from the home. The system includes at least one motion sensor positioned to detect a first activity and to transmit a first signal indicative of the first activity and at least one exterior door sensor positioned to detect motion of an exterior door of the home and to transmit a second signal indicative of the motion. Further, the system includes a monitoring center in communication with the at least one motion sensor and the at least one exterior door sensor. The monitoring center is adapted to determine whether a resident of the home is inactive within the home or is away from the home based upon the timing of the first signal relative to the second signal.

In one aspect of the system embodiment of the invention, the at least one motion sensor is a wireless motion sensor that includes a timer adapted to run a pre-selected time period after the detection of the first activity. Further, in this one aspect, the system the at least one exterior door sensor includes at least one wireless exterior door sensor positioned to detect motion of an exterior door of the home and to transmit a second signal indicative of the motion.

In another aspect of the system embodiment of the invention the monitoring center is adapted to determine whether the home is in an active state, a quiet state, or an away state based upon the timing of the first signal relative to the second signal.

Another exemplary embodiment of the invention is a method for determining a state of activity within a home. The method includes providing at least one motion sensor to detect an activity event within a home and to transmit a first signal indicative of the activity event and providing at least one exterior door sensor to detect an exterior door movement event at the home and to transmit a second signal indicative of the exterior door movement event. Further, the method includes determining, with a central processing unit adapted to utilize information from the first and second signals in a state model, whether the home is in an active state, a quiet state, or an away state based upon the timing of the first signal relative to the second signal.

Another exemplary method embodiment of the invention is a method for determining whether a resident is within a home or away from the home. The method includes the steps of sensing motion within the home, wirelessly sending a first signal to a central monitoring center indicating the home is in an active state, and starting a timer for a pre-determined period of time. Upon expiration of the pre-determined period of time without sensing any further motion within the home, a second signal is wirelessly sent to the central monitoring center indicating the home is in a quiet state. Further, the method senses movement of an exterior door to the home and sends a third signal to the central monitoring center indicative of the movement of the exterior door. Finally, the method compares a time of the third signal with the time of the second signal to determine whether a resident of the home has left the home or is inactive within the home.

These and other advantages and features will be more readily understood from the following detailed description of preferred embodiments of the invention that is provided in connection with the accompanying drawings.

DETAILED DESCRIPTION OF THE PREFERRED EMBODIMENTS

Referring now to the drawings, where like numerals relate to like features, there is shown in FIG. 1 a wireless motion sensor 10 constructed in accordance with an exemplary embodiment of the invention. The motion sensor 10 includes a transmitter 12, a processor 14, and a timer 16. The processor 14 includes logic portions of the sensor 10.

The motion sensor 10 further includes a detector section 18. The detector section 18 includes a hardware portion 20 and a signal processor 22. The hardware portion 20 includes a sensing portion that detects motion. The hardware portion 20 serves to pass an amplified and filtered version of the output of the sensing portion to the signal processor 22. The signal processor 22 includes necessary logic to determine if the signal coming from the hardware portion 20 constitutes a human activity. The hardware portion 20 preferably includes a passive infrared motion detector mechanism. Alternatively, the hardware portion may include ultrasonic, microwave, radar, or infrared motion detectors, or any combinations of these, such as, for example, infrared with microwave or infrared with radar. The signal processor 22 takes signals from the hardware portion 20 and determines what is motion.

Figure 2:
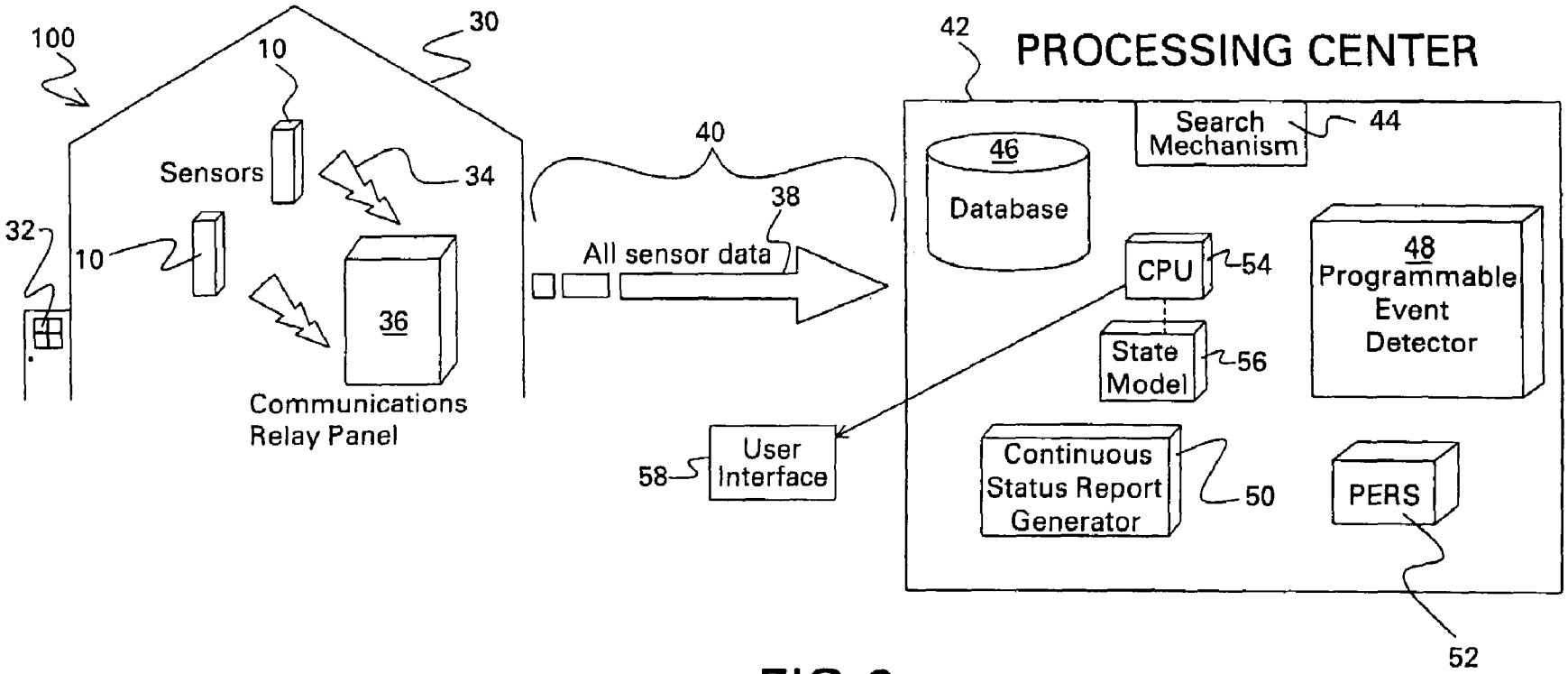
FIG. 2 is a schematic view of a system using the motion sensor of FIG. 1.

With reference to FIG. 2, an activity monitoring system 100, including the motion sensor 10, is illustrated. The activity monitoring system 100 includes, in addition to one or more motion sensors 10, one or more exterior door sensors 32, a communication relay panel 36, and a remote processing or monitoring center 42. The activity monitoring system 100 lacks mechanisms to intervene in the home 30 or any subsystems (appliances, water, lights, etc.) of the home 30. Intervention in the home 30, if any, may arrive through a communication with the resident of the home 30 from outside the home, such as via a telephone call or a visit from a caregiver or other suitable person, such as an emergency response professional. The motion sensors 10 may include sensors positioned about the home 30 to detect activity of the resident, or may be inside door sensors, cabinet sensors, kitchen and appliance sensors, and any other sensors suitable for collecting and communicating data regarding activities on-going in the home 30. Further, the motion sensors 10 may take any suitable form, such as, for example, a module attached to a wall, interior door, appliance, or cabinet drawer. Alternatively, the motion sensors 10 may take the form of a pad placed upon a bed, couch or chair to monitor a resident's use of same. The exterior door sensors 32 may be one or more sensors positioned on or near doors providing ingress and egress from the home 30. Preferably, the sensors 10, 32 are wireless sensors capable of wirelessly communicating signals 34, which include data collected, to the communications relay panel 36. It should be appreciated, however, that the sensors 10, 32 instead may be sensors hardwired to the communications relay panel 36.

The communications relay panel 36 communicates the sensor data collected from the sensors 10, 32 by sending a data signal 38 containing the sensor data to the remote monitoring center 42 by way of a suitable wired or wireless communications platform 40, such as, for example, wired telephone, wireless telephone, two-way walkie-talkie, pager, cable, the Internet, or any other suitable wired or wireless communication platform. Depending upon the communication platform 40 chosen, the data signals 38 may be sent in near real-time or may be sent at discrete, irregular intervals. By near real-time is meant within the range of almost instantaneously to up to three minutes. For example, data signals 38 may be sent in near real-time via wireless telephone, two-way walkie-talkie, pager, cable, the Internet or any other wireless communication platform. If a wired telephone communication platform is utilized, the data signals 38 may be buffered and transmitted at differing intervals.

The monitoring center 42, which is remote from the home 30, includes a database 46, a programmable event detector 48, a continuous status report generator 50, a PERS 52, a central processing unit (CPU) 54, and a State Model 56. The database 46 serves as a collection vessel for the sensor data communicated via the signals 38. A search mechanism 44 is used for searching the database 46. Upon a request from the caregiver for a status report, the sensor data is forwarded from the database 46 to the continuous status report generator 50. The status report generator 50 communicates a near real-time status signal to a personal computer of the caregiver. By near real-time is meant anywhere in the range of almost instantaneously to up to three minutes. For example, for a two-way page communication platform 40, the amount of time required for the communication can be between two and three minutes. The status report generator 50 may be programmed to update the report for each home 30 at a certain interval, such as, for example, every ten minutes. The status signal includes a report generated by the continuous status report generator 50. The format and substance of the report are dependent upon the request of the caregiver and can be modified at the request of the caregiver. It should be appreciated that the signal can instead be communicated via a personal digital assistant (PDA), a pager, a facsimile machine, cable, or a telephone or voice-mail account instead of via the personal computer.

The caregiver 38 can also select certain activities that, if they occur in the home 30, would be considered an event. An event, in general, would include an activity or any important transition occurrence, such as a state transition (the change from one state to another, such as, for example, from active to quiet), of which a caregiver would want to be apprised. For example, use of an exterior door may be considered an important activity or state transition occurrence. The caregiver communicates the parameters of what constitutes an event to the remote monitoring center 42, such as, for example, setting the parameters via a website. While the caregiver does not determine whether an event has occurred, the caregiver can select from a set of predefined activities that constitutes an event. Further, the caregiver sets the parameters to configure the events to match the normal activity of the resident in the home 30. For example, the caregiver does not define what constitutes, for example, "wake up", but the caregiver can define when "wake up" would be considered late. The sensor data is stored and processed at the monitoring center 42. If the data indicates the occurrence of an event, a signal is sent to the caregiver via any suitable communication medium, such as, for example, wired or wireless telephone, PDA, pager, facsimile, cable, two-way walkie-talkie, e-mail, or other Internet-supported communication media, such as, for example, through a pop-up announcement format. The caregiver is then provided the opportunity to open a communication pathway with the person residing in the home 30. The communication pathway may be through a wired or wireless telephone line, the Internet browser (i.e., e-mail or other Internet-sponsored communication tool), cable, PDA, pager, or personal, such as a visit by the caregiver or another suitable person.

The sensors 10, 32 can be positioned in various locations throughout the home 30. The sensors 10, 32 may be categorized by types, for example, as motion, exterior door (sensor 32), food, or automobile sensors. It should be appreciated that the number of sensors 10, 32 used may depend upon the layout of the home 30, as well as other factors.

Figure 4:
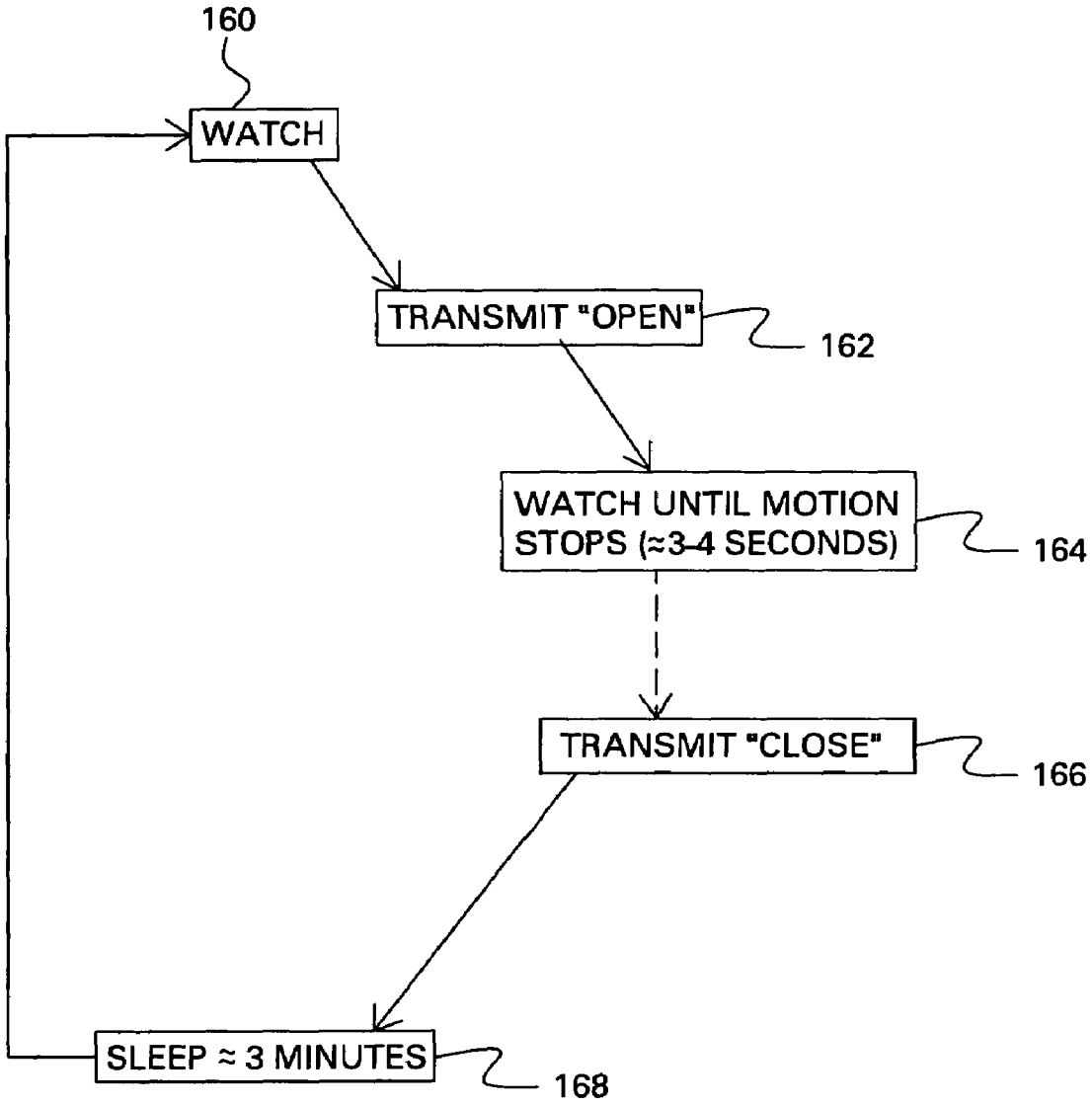
FIG.4 (PRIOR ART)
FIG. 4 is a flow diagram of the process steps taken by a conventional motion sensor in ascertaining whether a resident is at home or away.

Next, with specific reference to FIG. 4, will be described a conventional process for determining when motion is occurring in a room monitored by a motion sensor. At Step 160, the motion sensor watches for any detectable sign of motion or activity. When motion is detected, an "Open" signal is transmitted at Step 162. At Step 164, the motion sensor continues to watch until no further motion has been seen for about three to four seconds. At this juncture, the sensor may optionally transmit a "Close" at Step 166. The sensor, regardless of whether Step 166 occurs, then goes to sleep, or temporarily becomes inactive, for about three minutes at Step 168.

By going to sleep at Step 168, the use of conventional wireless motion sensors may lead to anomalous results. For example, a resident may open an exterior door, such as a door off of the kitchen to put out the garbage, put out the garbage and close the door and move to the bedroom within a time span of less than three or four minutes. By opening the exterior door, the conventional motion sensor has reported an open at Step 162, and then gone into the sleep mode at Step 168. During that sleep mode, the resident has ample time to close the exterior door, go to his bedroom and go to bed. Under such a scenario, the system will sense no further movement within the home, thus leading the system to conclude that the resident has left the home.

The motion sensors 10 within the activity monitoring system 100 utilize a different logic scheme to address the disadvantages of the approximately four-minute long sleep period experienced by conventional motion sensors.

Figure 3:
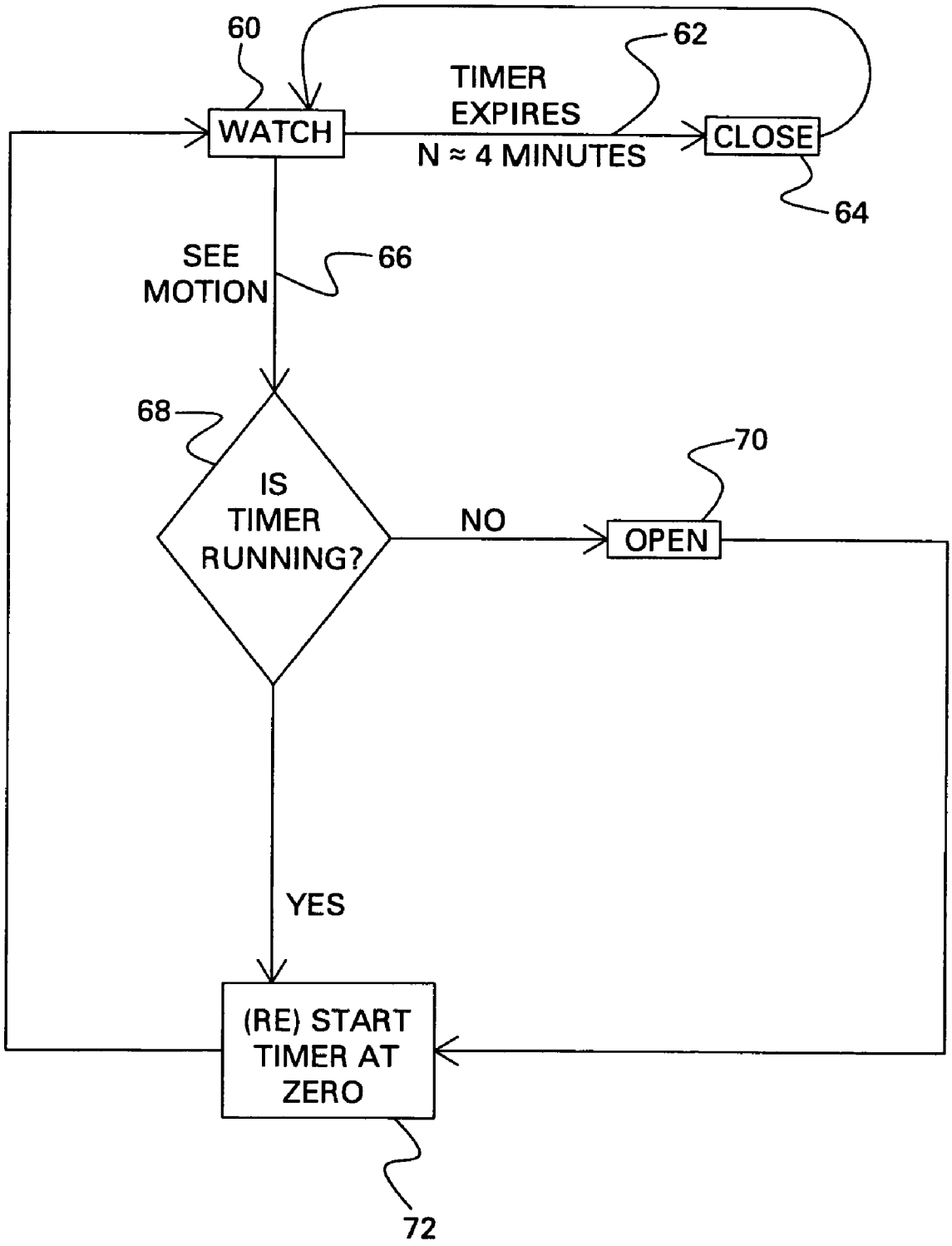
FIG. 3 is a flow diagram of the process steps taken by the motion sensor of FIG. 1 in ascertaining whether a resident is at home or away.

With reference to FIG. 3, next will be described the flow logic of the motion sensors 10. At Step 60, the detector 18 of the motion sensor 10 watches for any detectable sign of motion or activity. While the motion sensor 10 watches for activity, the timer 16 (FIG. 1) is running. If the motion sensor 10 sees motion at Step 66, the processor 14 initiates a query 68 as to whether the timer 16 is running. Upon seeing motion for the first time, the timer 16 will not be running, and thus, at Step 70 an open is reported via a first signal from the transmitter 12. By open is meant that the detector 18 has detected activity. The detector 18 of the motion sensor 10 will continue to watch; however, no further motion will be reported, as continuous reporting takes up battery power. If the timer 16 is running, at Step 72 the timer 16 is restarted at zero. If the timer 16 is not running and after the open has been reported, the timer 16 is started at zero at Step 72. After Step 72, the logic returns to Step 60 and the motion sensor 10 watches for renewed motion. Typically, motion occurs intermittently, and so if the detector 18 sees motion again at Step 66 before the timer expires at Step 62, the answer to the query at Step 68 will be yes, and that will be followed by a restarting of the timer 16 at zero at Step 72.

Upon expiration of the timer 16, which was started or restarted at Step 72 and which occurs after N minutes at Step 62, at Step 64 a close is reported via a second signal from the transmitter 12. By close is meant that no activity has been detected within the N time period. Preferably, the N time period for which the timer 16 runs before expiring is about four minutes. It should be appreciated, however, that any amount of time should be suitable as long as the N time period is known. Longer N time periods may be useful in diminishing radio traffic and increasing battery life of the sensors 10, 32. After reporting a close at Step 64, the logic returns to Step 60.

The open and the close are both reported by transmitting the first and second signals to the monitoring center 42. An algorithm is utilized to calculate the actual close time of the timer 16, thus providing an actual time that activity ceased within the home 30. By comparing the actual time that activity has ceased in the home 30 with data from the external door sensors 32, an accurate determination as to whether inactivity within the home 30 is due to the resident being away from the home 30 can be made. Alternatively, whether inactivity within the home 30 is due to the resident ceasing to move also can be more accurately determined.

Next, with reference to FIG. 5, will be described the changes of state within the home 30 identified by the system 100. Each of the states is determined by an event. The Quiet State 200 is a state of inactivity within the home 30, meaning total inactivity of all the sensors 10, 32 in the home 30 for a certain period of time. Event 202*a*, which depicts the opening of an outer door as monitored by the external door sensors 32, moves the home 30 from the Quiet State 200 to the Door Open State 204. If sensors 10 monitor further activity in the home 30, as depicted by Event 212*b*, then the home 30 moves to the Active State 216. If instead no further activity is monitored by the sensors 10 or the door sensors 32 for a pre-determined period of time, as depicted by Event 202*b*, the home 30 reverts back to the Quiet State 200. The pre-determined period of time is configurable. If instead the door sensors 32 monitor the outer door being closed, as depicted at Event 206, the home 30 will instead change to the Door Close State 208.

While in the Door Close State 208, the door sensors 32 can time out at Event 210*b*, sending the home back into the Quiet State 200. The time out period is a configurable, pre-determined period of time. If the outer door opens again, as depicted by Event 210*a*, the home 30 reverts to the Door Open State 204. From the Door Close State 208, if the sensors 10 monitor opening of the outer door, as depicted by Event 214*b*, then the home 30 moves to the Active State 216.

From the Active State 216, the home 30 can move to the Quiet State 200 by the sensors 10 timing out, as depicted by the Event 218*b*. It should be appreciated that the amount of time for the time out depicted in the Event State 218*b* may be pre-selected and may be hardwired into the sensors 10 at, for example, about four minutes. The home 30 can then move back to the Active State by the sensors 10 monitoring movement in the home 30, as depicted by the Event 218*a*. Further, the home 30 can move from the Active State 216 to the Door Open State 204 by the door sensors 32 monitoring opening of an outer door, as depicted by Event 212*a*. Finally, from the Active State 216, the home 30 can revert to the Door Close State 208 by the door sensors 32 monitoring the outer door closing, as depicted by the Event 214*a*.

Figures 5, 6:
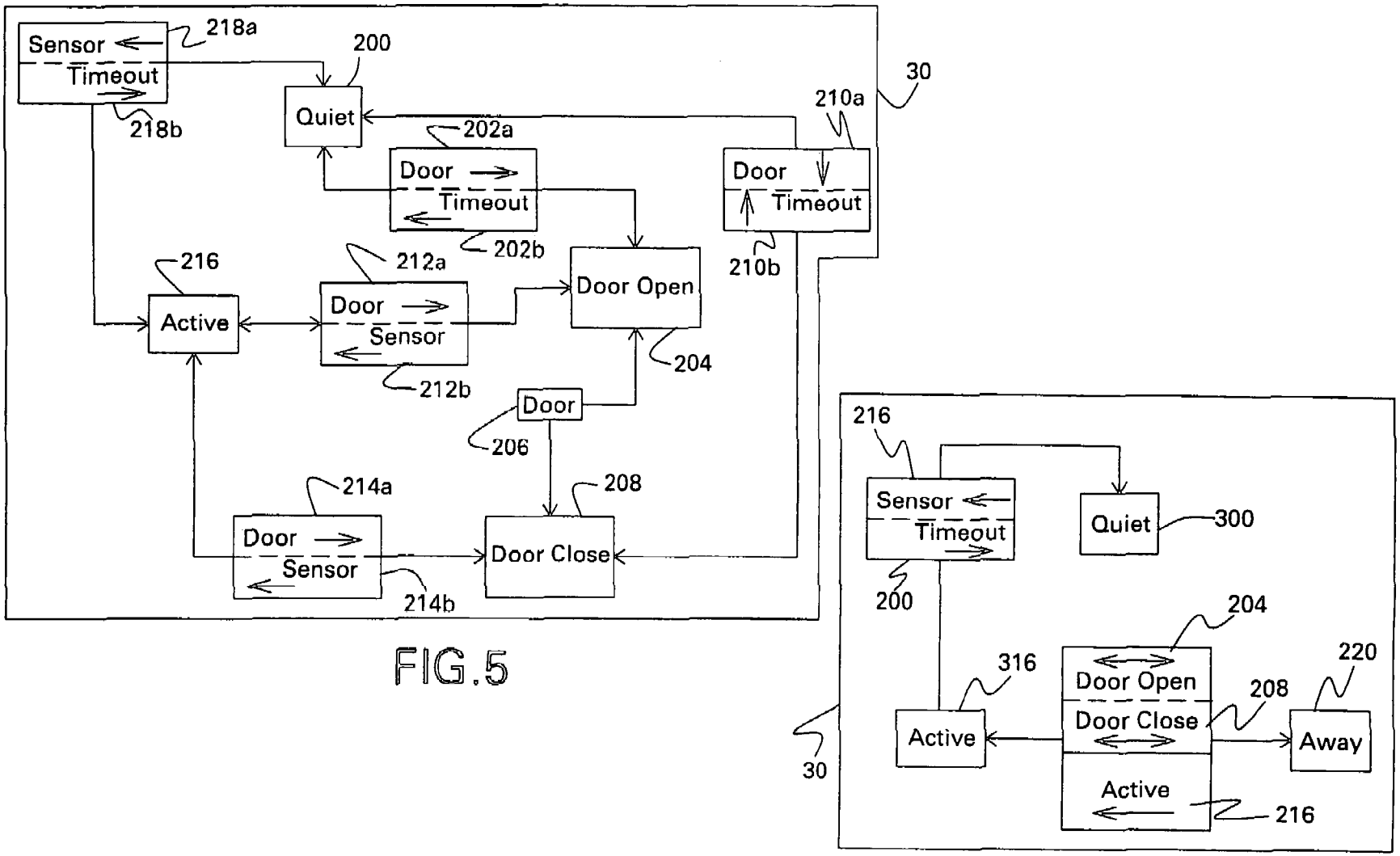
FIG. 5 is a diagram illustrating the states in a home equipped with the motion sensor of FIG. 1.
FIG. 6 is a higher level state diagram based upon the state diagram of FIG. 5.

The state diagram of FIG. 5 illustrates a first step in the methodology of the system 100 in determining whether a resident of the home 30 has left the residence or is merely inactive within the home 30. For example, if the home 30 moves from the Active State 216 to the Quiet State 200 without passing through the Door Open State 204, then the system 100 presumes that the resident is within the home 30 and merely inactive. If, on the other hand, the home 30 moves from the Active State 216 to the Door Open State 204, then to the Door Close State 208 and finally to the Quiet State 200, the system 100 presumes the resident has left the home 30. Additional transitions may also lead to the presumption that the resident has left the home 30, such as Active, Door Open, Active, Quiet, Door Close.

FIG. 6 illustrates a higher level abstraction of the state diagram of FIG. 5, and it occurs later in time than the state diagram of FIG. 5. The higher level of abstraction includes a Quiet State 300, an Active State 316 and an Away State 220. The Quiet State 300 is a state of complete quiet (no monitored activity) for an extended period of time. For example, if the Quiet State 200 represents a four minute period of time for which no activity has been monitored, the Quiet State 300 may represent a ten to fifteen minute period of time for which no activity has been monitored. Similarly, if the Active State 216 is a four minute period of time after which activity has been monitored, the Active State 316 may represent a ten to fifteen minute period of time that, on the whole, exhibits monitored activity, even though there may be some quiet stretches within. If the home 30 is in the Active State 316 and the sensors 10 time out (Quiet State 200) and no further activity is monitored for an extended period of time, the home 30 moves into the Quiet State 300. Conversely, if the home 30 is in the Quiet State 300, and activity is monitored by the sensors 10 (Active State 216), the home 30 moves into the Active State 316. If, while in the Active State 316, the door sensors 32 monitor the opening of the outer door (Door Open 204), the home 30 moves from the Active State 316 to the Away State 220. If, while in the Away State 220, the door sensors 32 monitor the opening and closing of the outer door (Door Open 204 and Door Close 208) and the sensors 10 monitor activity (Active State 216), the home 30 moves to the Active State 316.

The State Model 56 (FIG. 2) includes algorithms including the logic of the state diagrams of FIGS. 5 and 6. The CPU 54 computes the algorithms of the State Model 56 and submits output to a User Interface 58. The User Interface 58 is used by the caregiver to monitor the activity within the home 30 in an unobtrusive manner.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. A system for determining whether a resident of a home is inactive within the home or away from the home, comprising:

at least one motion sensor positioned to detect a first activity and to transmit a first signal indicative of the first activity and a signal processor for processing the first activity signal;

at least one exterior door sensor positioned to detect motion of an exterior door of the home and to transmit a second signal indicative of the motion; and a monitoring center in communication with the at least one motion sensor and the at least one exterior door sensor, wherein the monitoring center is adapted to determine whether a resident of the home is inactive within the home or is away from the home based upon the timing of the first signal relative to the second signal wherein the at least one motion sensor comprises a timer adapted to run a pre-selected time period after the detection of the first activity.

2. The system of claim 1, wherein the pre-selected time period is no greater than five minutes.

3. The system of claim 1, further comprising a communications relay panel for relaying the first and second signals to the monitoring center.

4. The system of claim 3, wherein the at least one motion sensor comprises a wireless sensor.

5. The system of claim 3, wherein the at least one exterior door sensor comprises a wireless sensor.

6. The system of claim 1, wherein the at least one motion sensor comprises one or more sensors from the group consisting of inside door sensors, cabinet sensors, kitchen sensors, appliance sensors, cabinet drawer sensors, bed sensors, couch sensors, and chair sensors.

7. The system of claim 1, wherein the at least one motion sensor comprises:

a detector for detecting activity, the detector comprising a sensing portion; and a transmitter for transmitting the first signal indicative of the first activity.

8. The system of claim 7, wherein the sensing portion comprises at least one sensing mechanism utilizing a sensing technique from the group consisting of passive infrared, ultrasound, microwave, radar, infrared, and any combinations thereof.

9. A system for determining whether a resident of a home is inactive within the home or away from the home, comprising:

at least one wireless motion sensor positioned to detect a first activity and to transmit a first signal indicative of the first activity, wherein the at least one wireless motion sensor comprises a timer adapted to run a pre-selected time period after the detection of the first activity and a signal processor for processing the first activity signal;

at least one wireless exterior door sensor positioned to detect motion of an exterior door of the home and to transmit a second signal indicative of the motion;

a communications relay panel for relaying the first and second signals to the monitoring center; and a monitoring center in communication with the communications relay panel, wherein the monitoring center is adapted to determine whether a resident of the home is inactive within the home or is away from the home based upon the timing of the first signal relative to the second signal.

10. The system of claim 9, wherein the pre-selected time period is no greater than five minutes.

11. The system of claim 9, wherein the at least one wireless motion sensor comprises one or more sensors from the group consisting of inside door sensors, cabinet sensors, kitchen sensors, appliance sensors, cabinet drawer sensors, bed sensors, couch sensors, and chair sensors.

12. The system of claim 9, wherein the at least one wireless motion sensor comprises:

a detector for detecting activity, the detector comprising a sensing portion; and a transmitter for transmitting first signal indicative of the first activity.

13. A method for determining a state of activity within a home,comprising:

providing at least one motion sensor to detect an activity event within a home and to transmit a first signal indicative of the activity event;

providing at least one exterior door sensor to detect an exterior door movement event at the home and to transmit a second signal indicative of the exterior door movement event; and determining, with a central processing unit adapted to utilize information from the first and second signals in a state model, whether the home is in an active state, a quiet state, or an away state based upon the timing of the first signal relative to the second signal wherein the step to determine whether the home is in a quiet state comprises: ascertaining the home is not in an away state; and ascertaining that the at least one motion sensor has closed for a pre-determined and configurable period of time; and ascertaining that the at least one motion sensor has not opened or closed within the period of time.

14. The method of claim 13, wherein the step to determine whether the home is in an active state comprises ascertaining that the at least one motion sensor has transmitted the first signal.

15. The method of claim 13, wherein the step to determine whether the home is in an active state comprises ascertaining that the at least one motion sensor has opened or closed within a pre-determined and configurable period of time.

16. The method of claim 15, wherein the at least one motion sensor comprises one or more sensors from the group consisting of inside door sensors, cabinet sensors, kitchen sensors, appliance sensors, cabinet drawer sensors, bed sensors, couch sensors, and chair sensors.

17. The method of claim 13, wherein the step to determine whether the home is in an away state comprises ascertaining the exterior door movement event and ascertaining no activity with the at least one motion sensor prior to exterior door movement event.

18. The method of claim 13, wherein the step to determine whether the home is in an away state comprises ascertaining the exterior door movement event and ascertaining closing of the at least one motion sensor within a pre-determined and configurable time period after the exterior door movement event and ascertaining no further movement with the at least one motion sensor within the home thereafter.

19. A method for determining whether a resident is within a home or away from the home, comprising the steps of:

sensing motion within the home;

sending a first signal to a central monitoring center indicating the home is in an active state;

starting a timer for a pre-determined period of time, wherein upon expiration of the pre-determined period of time without sensing any further motion within the home, sending a second signal to the central monitoring center indicating the home is in a quiet state;

sensing movement of an exterior door to the home and sending a third signal to the central monitoring center indicative of the movement of the exterior door; and comparing a time of the third signal with the time of the second signal to determine whether a resident of the home has left the home or is inactive within the home.

20. The method of claim 19, wherein the sending of the first and second signals is accomplished by wirelessly sending the first and second signals to a communications relay panel and subsequently sending the first and second signals to the central monitoring center.

21. The method of claim 19, wherein the watching is accomplished with a sensor utilizing a sensing technique from the group consisting of passive infra-red, ultrasound, microwave, radar, infra-red, and any combinations thereof.

* * * * *